US009030387B2

(12) United States Patent
Jeong et al.

(10) Patent No.: US 9,030,387 B2
(45) Date of Patent: May 12, 2015

(54) LIGHT EMITTING DISPLAY DEVICE AND DRIVING METHOD THEREOF

(71) Applicant: LG Display Co., Ltd., Seoul (KR)

(72) Inventors: Ui-Taek Jeong, Seoul (KR); Na-Ri Kim, Hanam-si (KR); Ji-Eun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 114 days.

(21) Appl. No.: 13/725,416

(22) Filed: Dec. 21, 2012

(65) Prior Publication Data

US 2013/0169699 A1 Jul. 4, 2013

(30) Foreign Application Priority Data

Dec. 29, 2011 (KR) ..... 10-2011-0145889

(51) Int. Cl.
*G09G 3/30* (2006.01)
*G09G 3/32* (2006.01)

(52) U.S. Cl.
CPC ..... *G09G 3/3225* (2013.01); *G09G 3/3233* (2013.01); *G09G 2320/0295* (2013.01)

(58) Field of Classification Search
CPC ..... G09G 3/3225; G09G 3/3233; G09G 2320/0295; G09G 2300/0819; G09G 3/3291; G09G 2300/0866; G09G 2320/0233; G09G 2320/029
USPC ..... 345/76, 204–214, 690–699; 315/169.3
See application file for complete search history.

(56) References Cited

U.S. PATENT DOCUMENTS

| | | | | |
|---|---|---|---|---|
| 7,535,442 | B2 | 5/2009 | Yamashita et al. | |
| 8,164,546 | B2 * | 4/2012 | Odawara et al. | 345/76 |
| 8,269,803 | B2 * | 9/2012 | Yoo et al. | 345/690 |
| 8,547,307 | B2 * | 10/2013 | Shirouzu et al. | 345/76 |
| 2010/0141627 | A1 * | 6/2010 | Yamashita et al. | 345/211 |
| 2010/0188320 | A1 | 7/2010 | Min et al. | |
| 2010/0214273 | A1 * | 8/2010 | Shirouzu et al. | 345/205 |
| 2010/0245331 | A1 * | 9/2010 | Shirouzu et al. | 345/212 |
| 2010/0259527 | A1 * | 10/2010 | Odawara et al. | 345/211 |

(Continued)

FOREIGN PATENT DOCUMENTS

JP 2001-350442 12/2001

(Continued)

OTHER PUBLICATIONS

Search and Examination Report issued in corresponding United Kingdom Patent Application No. GB1222842.5, mailed May 16, 2013.
Office Action issued in corresponding Japanese Patent Application No. 2012-280467, mailed Mar. 11, 2014, 2 pages.
Office Action issued in corresponding German Patent Application No. 10 2012 024 539.4, mailed May 8, 2014, 14 pages.

*Primary Examiner* — Dmitriy Bolotin
(74) *Attorney, Agent, or Firm* — Brinks Gilson & Lione

(57) ABSTRACT

Disclosed is a light emitting display device capable of minimizing deviation of current driving capability between driving switching devices of respective pixels, thereby achieving enhanced screen quality. A method of driving the light emitting display device includes sensing the threshold voltage and mobility of driving Thin Film Transistor (TFT) of each pixel through each data line or each power line using a first sensing voltage; correcting an error of the mobility between the driving TFTs by again sensing the mobility of the driving TFT of each pixel through each data line or each power line using a second voltage; and compensating for video data to be displayed on a display panel using the threshold voltage and the corrected mobility.

8 Claims, 4 Drawing Sheets

(56) References Cited

U.S. PATENT DOCUMENTS

| | | | | |
|---|---|---|---|---|
| 2011/0210958 | A1* | 9/2011 | Yoo et al. | 345/214 |
| 2011/0216056 | A1 | 9/2011 | Yoo et al. | |
| 2011/0254871 | A1* | 10/2011 | Yoo et al. | 345/690 |
| 2013/0093652 | A1 | 4/2013 | Kim et al. | |

FOREIGN PATENT DOCUMENTS

| | | | |
|---|---|---|---|
| JP | 2004-252110 | | 9/2004 |
| JP | 2010-237581 | | 10/2010 |
| JP | 2011-221480 | | 11/2011 |
| WO | WO 2009110132 | A1 | 9/2009 |

* cited by examiner

LIGHT EMITTING DISPLAY DEVICE AND DRIVING METHOD THEREOF

This application claims the benefit of Korean Patent Application No. 10-2011-0145889, filed on, Dec. 29, 2011, which is hereby incorporated by reference as if fully set forth herein.

BACKGROUND

1. Field of the Disclosure

The present disclosure relates to a light emitting display device and a driving method thereof capable of minimizing deviation of current driving capability between driving switching devices of respective pixels, thereby achieving enhanced screen quality.

2. Discussion of the Related Art

Pixels of a light emitting display device include driving Thin Film Transistors (TFTs) as constant current elements. Current driving capability of the driving TFTs is greatly affected by the threshold voltage of the driving TFTs.

Accordingly, there is a demand for techniques to correct deviation of current driving capability between driving TFTs of respective pixels.

SUMMARY

A method of driving a light emitting display device includes sensing the threshold voltage and mobility of driving Thin Film Transistor (TFT) of each pixel through each data line or each power line using a first sensing voltage; correcting an error of the mobility between the driving TFTs by again sensing the mobility of the driving TFT of each pixel through each data line or each power line using a second voltage; and compensating for video data to be displayed on a display panel using the threshold voltage and the corrected mobility.

A light emitting display device includes a display panel including pixels, each of the pixels connecting with a data line and a power line and including a driving TFT; a data driver supplying a sensing voltage to the each pixel through the data line and sensing a voltage corresponding to a pixel current, depending upon a threshold voltage and mobility of the driving TFT, through the data line or the power line by using the first voltage; and a timing controller sensing the threshold voltage and mobility of the driving TFT using the sensed voltage from the data driver, again sensing the mobility of the driving TFT of each pixel through the data driver and each data line or each power line to correct an error of the mobility between the driving TFTs and compensating for video data to be displayed on a display panel using the threshold voltage and the corrected mobility.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Hereinafter, a driving method of a light emitting display device according to embodiments of the present invention will be described in detail with reference to illustrations of the accompanying drawings.

Figure 1:
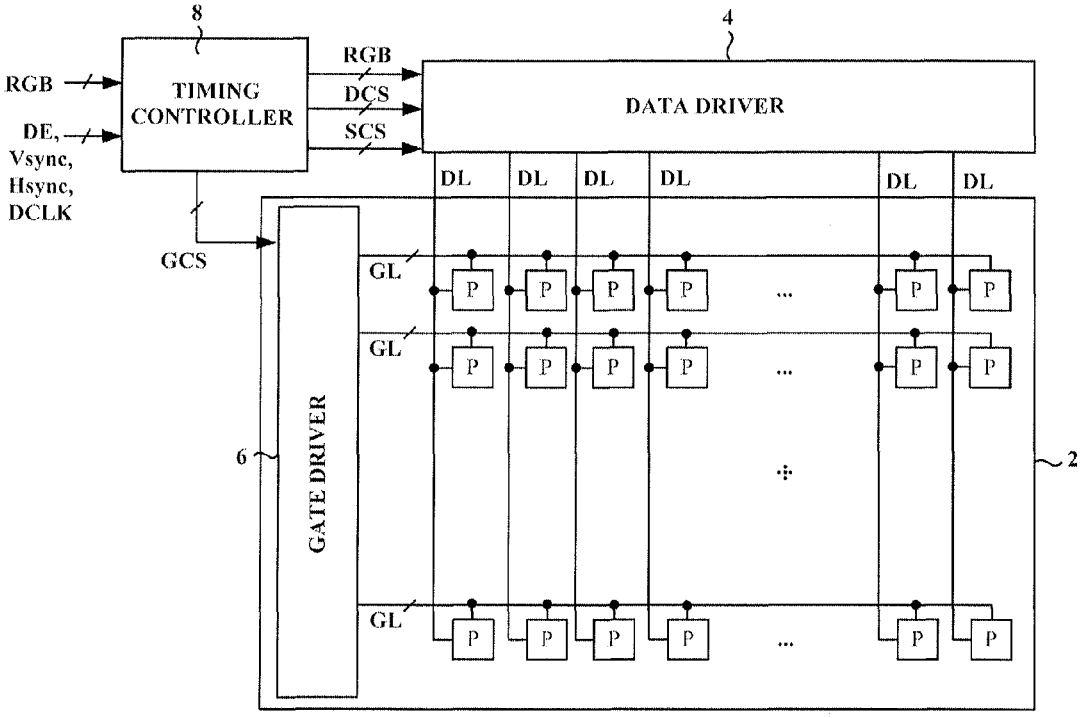
FIG. 1 is a diagram illustrating the configuration of a light emitting display device according to an embodiment.

FIG. 1 is a diagram illustrating the configuration of a light emitting display device according to an embodiment.

The light emitting display device illustrated in FIG. 1 includes a display panel 2, a data driver 4, a gate driver 6, a timing controller 8, and a power supply unit 10.

The display panel 2 includes a plurality of data lines DL and a plurality of gate lines GL arranged intersecting each other, and pixels P arranged in a matrix form. Each pixel P includes a Light Emitting Diode (LED), a driving Thin Film Transistor (TFT) to supply driving current to the LED, and a plurality of TFTs to compensate the threshold voltage and mobility of the driving TFTs.

The data driver 4 includes one or more source drive Integrated Circuits (ICs) (not shown). The data driver 4 receives digital video data RGB from the timing controller 8. On the other hand, the data driver 4 may receive digital video data RGBW from the timing controller 8. Then, the data driver 4 converts the digital video data RGB to gamma compensation voltages to generate data voltages in response to a data control signal DCS from the timing controller 8, and supply the data voltages to the data lines DL of the display panel 2, respectively. The data driver 4 senses a voltage discharged corresponding to a pixel current, which is depended upon the threshold voltage and mobility of the driving TFT of each pixel P, through each channel of the plurality of data lines DL or each channel of the plurality of power lines in response to a sensing control signal SCS from the timing controller 8, and supply the sensed voltage per a pixel to the timing controller 8. The data driver 4 converts the sensed voltage to digital data to supply to the timing controller 8. The source drive ICs may be connected to the data lines DL of the display panel 2 via a Chip On Glass (COG) process or a Tape Automated Bonding (TAB) process.

The gate driver 6 outputs a plurality of gate signals in response to a gate control signal GCS from the timing controller 8. The plurality of gate signals may include a plurality of scan pulses and a plurality of light emitting control signals, for example. The gate driver 6 sequentially outputs the plurality of gate signals from the first gate line GL to the last gate line GL. The gate driver as described above may be directly formed on a lower substrate of the display panel 2 in a Gate-In-Panel (GIP) manner, or may be connected between the gate lines GL of the display panel 2 and the timing controller 8 in a TAB manner.

The timing controller 8 receives the digital video data RGB from an external host computer through an interface, such as a Low Voltage Differential Signaling (LVDS) interface or a Transition Minimized Differential Signaling (TMDS) interface, for example. The timing controller 8 transmits the digital video data RGB input from the host computer to the source drive ICs. The timing controller 8 receives timing signals, such as a vertical synchronization signal Vsync, horizontal synchronization signal Hsync, data enable signal DE, and dot clock signal DCLK, for example, from the host computer through an LVDS or TMDS interface receiving circuit. The timing controller 8 generates the timing control signals DCS and GCS to control operation timing of the data and gate drivers 4 and 6 based on the timing signals from the host computer.

The timing controller 8 generates the sensing control signal SCS to sense the threshold voltage and mobility of the driving TFT in the each pixel P using the sensed voltage per a pixel through the data driver 4. The timing controller 8 compensates for the video data RGB using the sensed threshold voltage and mobility of the driving TFT and supplies the compensated video data RGB to the data driver 4. Thereby, the data driver 4 converts the compensated video data RGB to data voltages to supply the data voltages to the display panel 2.

In particular, senses the threshold voltage and mobility of the driving TFT of each pixel P using sensing data through the data driver 4 and the data lines or the power lines of the display panel 2 and store the sensed threshold voltage and mobility of the driving TFT in a memory. On the other hand, the timing controller 8 may detects and store an offset based on the sensed threshold voltage and a gain based on the mobility in the memory. The timing controller 8 compensates for the sensing data using the stored threshold voltage and mobility of the driving TFT. On the other hand, the timing controller 8 may compensates for the sensing data using the stored offset and gain.

And then, the timing controller 8 again senses the mobility of the driving TFT of each pixel P using the compensated sensing data and corrects an error of the mobility of the driving TFT to store the corrected mobility of the driving TFT. On the other hand, the timing controller 8 may correct the gain based on the corrected mobility and store the corrected gain.

If it is judged that the mobility error of the driving TFT is corrected to a predetermined rate or more, the timing controller 8 finishes correcting the mobility. The timing controller 8 compensates for the video data RGB using the threshold voltage and the corrected mobility and supplies the compensated video data RGB to the data driver 4. On the other hand, the timing controller 8 compensates for the video data RGB using the gain and the corrected mobility and supplies the compensated video data RGB to the data driver 4. In this way, the present embodiment may contribute to reduction in deviation of current driving capability between the driving TFTs of the respective pixels, and consequently to enhancement of screen quality.

Hereinafter, a driving method of the light emitting display device according to the embodiment will be described in detail.

Figure 2:
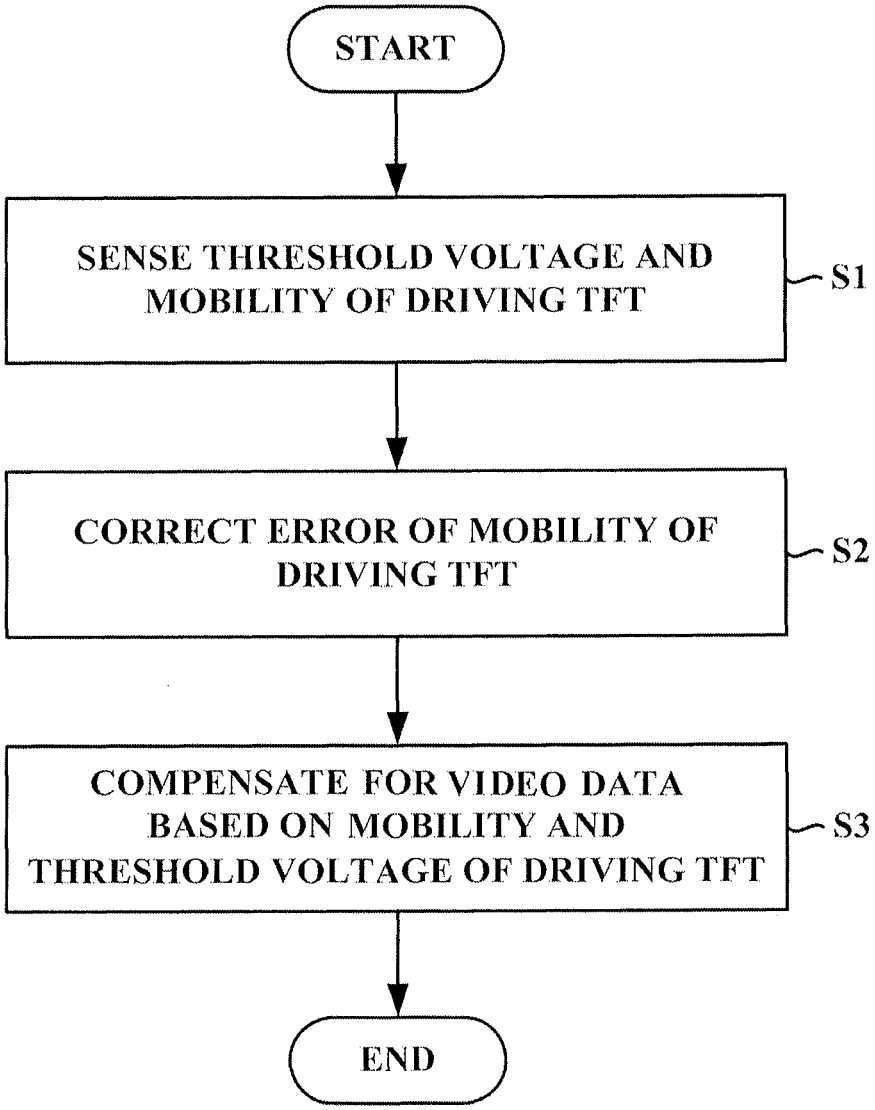
FIG. 2 is a flowchart illustrating a driving method of the light emitting display device according to the embodiment.
Figure 3:
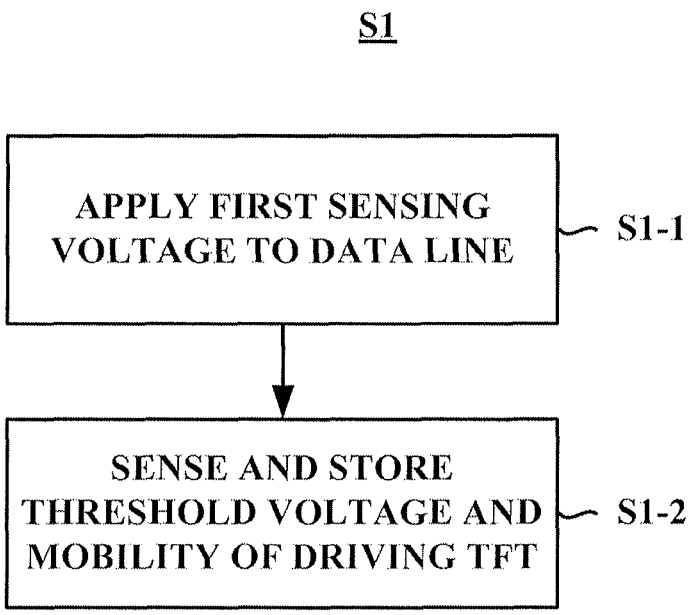
FIG. 3 is a flowchart illustrating a first step illustrated in FIG. 2 in detail.
Figure 4:
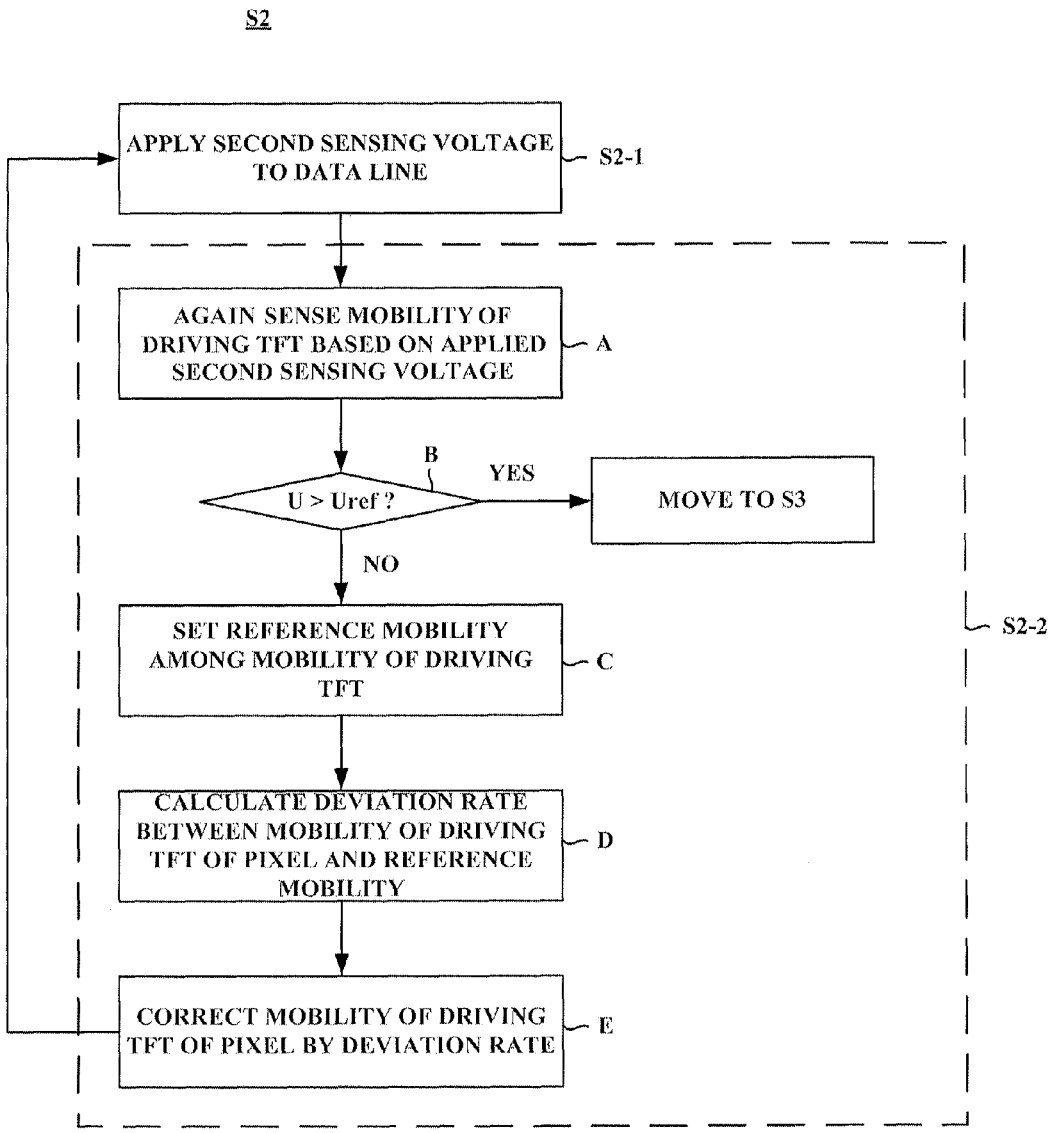
FIG. 4 is a flowchart illustrating a second step illustrated in FIG. 2 in detail.

FIG. 2 is a flowchart illustrating a driving method of the light emitting display device according to the embodiment, FIG. 3 is a flowchart illustrating a first step illustrated in FIG. 2 in detail, and FIG. 4 is a flowchart illustrating a second step illustrated in FIG. 2 in detail.

Referring to the flowchart of FIG. 2, the driving method includes a first step S1 and a second step 2.

The first step S1 includes sensing the threshold voltage and mobility of the driving TFT of each pixel P using a sensing data (a first sensing voltage) through the data driver 4 and each data line DL or each power line and storing the sensed threshold voltage and mobility of the driving TFT per each pixel. The first step S1 may further include detecting and storing an offset based on the sensed threshold voltage per each pixel and a gain based on mobility per each pixel.

The second step S2 includes again sensing the mobility of the driving TFT using the compensated sensing data (a second sensing voltage) through the data driver 4 and each data line DL or each power line to correct a mobility error of the driving TFT and storing the corrected mobility. The second step S2 may further include correcting the gain based on the corrected mobility of the driving TFT and storing the corrected gain; and The third step S3 includes compensating for a video data RGB using the threshold voltage and the corrected mobility and supplying the compensated video data RGB to be displayed on the display panel 2. On the other hand, the third step S3 may include compensating for the video data RGB using the gain and the corrected mobility and supplying the compensated video data RGB to the data driver 4.

The first step S1, as illustrated in FIG. 3, includes a first substep S1-1 and a second substep S1-2.

The first substep S1-1 includes applying a first sensing voltage corresponding to the sensing data to each pixel through each data line DL, and causing a first voltage, corresponding to the applied first sensing voltage, to be discharged through the driving TFT of each pixel P.

The second substep S1-2 includes sensing and storing the threshold voltage and mobility of the driving TFT by sensing the magnitude of the first voltage discharged through each data line or each power line from the driving TFT of each pixel and the discharge gradient of the first discharged voltage.

The second substep S1-2 may further include detecting and storing an offset based on the sensed threshold voltage per each pixel and a gain based on mobility per each pixel.

The second step S2, as illustrated in FIG. 4, includes a first substep S2-1 and a fourth substep S2-4.

The first substep S2-1 includes compensating for the sensing data using the stored threshold voltage and mobility of the driving TFT from the first step S1, applying a second sensing voltage corresponding to the compensated sensing data to each pixel through each data line DL, and causing a second voltage, corresponding to the applied second sensing voltage, to be discharged through the driving TFT of each pixel P and each data line DL or each power line. On the other hand, the first substep S2-1 may including compensating for the sensing data using the stored offset and gain per each pixel from the first step S1, The second substep S2-2 includes a step of correcting an error of the mobility of the driving TFTs stored in the previous step S1-2 by sensing the gradient of the second voltage discharged through the data line or the power line from the driving TFT of each pixel and storing the corrected mobility. This substep S2-2 will now be described in more detail.

The second substep S2-2 includes steps A, B, C, D and E.

Step A includes sensing the mobility of the driving TFT of each pixel P by sensing the gradient of the second voltage discharged through the driving TFT.

Step B includes measuring uniformity in the mobilities of the driving TFTs of the respective pixels P sensed in Step A and moving to the third step S3 if the measured uniformity U is greater than a preset reference value Uref.

Step C includes setting a reference mobility among the mobilities of the driving TFTs of the pixels sensed in Step A if the measured uniformity U is less than or equal to the reference value Uref in the step B.

Step D includes calculating a deviation rate between the mobility of the driving TFT of each pixel sensed in Step A and the reference mobility. In Step D, the deviation rate is calculated as represented in Equation 1. Referring to Equation 1, the deviation rate is a ratio of the reference mobility to a difference between the reference mobility and the measured mobility.

$$\text{Deviation rate} = \frac{\text{reference mobility} - \text{sensed mobility}}{\text{reference mobility}} \quad \text{Equation 1}$$

Step E includes correcting the mobility of the driving TFTs stored in the previous step S1-2 by the deviation rate to enable implementation of the first substep S2-1, storing the corrected mobility and returning to the first substep S2-1. The step E may further include correcting the gain using the corrected mobility, and storing the corrected gain. In Step E, the mobility of the driving TFT is corrected as represented by Equation 2. Referring to Equation 2, the mobility of the driving TFT is corrected to a value obtained by multiplying the mobility of the driving TFTs with the deviation rate to obtain a corrected value and adding the corrected value to the mobility of the driving TFTs.

$$\text{Corrected Mobility} = \text{Mobility} + \text{Mobility} \times \text{Deviation Rate} \quad \text{Equation 2}$$

The third step S3 is a step of compensating for video data RGB using the threshold voltage stored in the previous step S1-2 and the mobility corrected in the previous step S2-2, and supplying the compensated video data RGB to the data driver 4. On the other hand, the third step S3 may include compensating for the video data RGB using the gain and the corrected mobility and supplies the compensated video data RGB to the data driver 4.

As is apparent from the above description, in the present embodiment, the threshold voltage and mobility of the driving TFT are sensed, and the mobility of the driving TFT is again sensed to correct an error of the mobility of the driving TFT. If it is judged that the mobility error of the driving TFTs is corrected to a predetermined rate or more, video data is compensated for based on the threshold voltage and the corrected mobility of the driving TFT to supply to a display panel. As such, the present embodiment may minimize deviation of current driving capability between the driving TFTs of the respective pixels, and achieve enhanced screen quality.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method of driving a light emitting display device, the method comprising:

sensing a threshold voltage and mobility of driving Thin Film Transistor (TFT) of each pixel through each data line using a first sensing voltage;

correcting an error of the mobility between the driving TFTs by again sensing the mobility of the driving TFT of each pixel through each data line using a second voltage, wherein the second sensing voltage use the first sensing voltage which the sensed threshold voltage and mobility are compensated for; and compensating for video data to be displayed on a display panel using the threshold voltage and the corrected mobility.

2. The method according to claim 1, wherein the sensing the threshold voltage and mobility of the driving TFT includes:

applying the first sensing voltage to the driving TFT of the each pixel and causing a first voltage, corresponding to the applied first sensing voltage, to be discharged through each data line from the driving TFT of the each pixel; and sensing and storing the threshold voltage and mobility of the driving TFT by sensing the magnitude of the first discharged voltage and the discharge gradient of the first discharged voltage.

3. The method according to claim 2, wherein the correcting the mobility error includes:

applying a second sensing voltage and causing a second voltage, corresponding to the applied second sensing voltage, to be discharged through each data line or each power line from the driving TFT of each pixel again sensing a mobility of the driving TFT by sensing the discharge gradient of the second discharged voltage; and correcting an error of the stored mobility using the again-sensed mobility.

4. The method according to claim 3, wherein the correcting the error of the stored mobility includes:

measuring uniformity in the again-sensed mobility of the driving TFTand passing to the step of compensating for the video data if the measured uniformity is greater than a preset reference value;

setting a reference mobility among a pluraity of the again-sensed mobilities of the driving TFTs if the measured uniformity is less than or equal to the reference value;

calculating a deviation rate between the again-sensed mobility and the reference mobility;

correcting the stored mobility of the driving TFT by the deviation rate; and storing the corrected mobility.

5. A light emitting display device comprising:

a display panel including pixels, each of the pixels connecting with a data line and including a driving TFT;

a data driver supplying a sensing voltage to the each pixel through the data line and sensing a voltage corresponding to a pixel current, depending upon a threshold voltage and mobility of the driving TFT, through the data line by using the sensing voltage; and a timing controller sensing the threshold voltage and mobility of the driving TFT using the sensed voltage from the data driver, again sensing the mobility of the driving TFT of each pixel through the data driver and each data line to correct an error of the mobility between the driving TFTs and compensating for video data to be displayed on a display panel using the threshold voltage and the corrected mobility.

6. The device according to claim 5, wherein the data driver supplies a first sensing voltage, corresponding to a sensing data from the timing controller, to the pixel through the data line; causes a first voltage to be discharged corresponding to the first sensing voltage through each data line from the driving TFT of the pixel; and senses the first discharged voltage; and wherein the timing controller senses and stores the threshold voltage and mobility of the driving TFT by sensing the magnitude of the first discharged voltage and the discharge gradient of the first discharged voltage.

7. The device according to claim 6, wherein the data driver supplies a second sensing voltage to each pixel through the data line; causes a second voltage to be discharged corresponding to the applied second sensing voltage through each data line from the driving TFT of each pixel; and senses the second discharged voltage, wherein the second sensing voltage is a voltage corresponding the sensing data which the stored threshold voltage and mobility are compensated for; and wherein the timing controller again senses a mobility of the driving TFT by sensing the gradient of the second discharged voltage to correct an error of the stored mobility using the again-sensed mobility and stored the corrected mobility.

8. The device according to claim 7, wherein the timing controller measures uniformity in the again-sensed mobility of the driving TFT, finish correcting the mobility if the measured uniformity is greater than a preset reference value, sets a reference mobility among a plurality of the again-sensed mobilities of the driving TFTs if the measured uniformity is less than or equal to the reference value, calculates a deviation rate between the again-sensed mobility and the reference mobility; corrects the stored mobility of the driving TFT by the deviation rate; and stores the corrected mobility.

* * * * *